United States Patent [19]

Bogan

[11] 4,231,482

[45] Nov. 4, 1980

[54] UNDERGROUND STORAGE VAULT

[76] Inventor: David B. Bogan, 15587 N. Bank Rd., Roseburg, Oreg. 97470

[21] Appl. No.: 2,574

[22] Filed: Jan. 11, 1979

[51] Int. Cl.[3] ..... B65D 6/00

[52] U.S. Cl. ..... 220/5 A; 220/72; 220/4 B; 220/4 E

[58] Field of Search ..... 220/5 A, 4 B, 4 E, 72, 220/80, 5 R

[56] References Cited

U.S. PATENT DOCUMENTS

| | | | |
|---|---|---|---|
| 1,362,878 | 12/1920 | Ladd | 220/5 R |
| 2,834,507 | 5/1958 | Metzler et al. | 220/4 B |
| 2,955,029 | 10/1960 | Foote | 220/4 B |
| 3,244,311 | 4/1966 | Lawson | 220/4 B |
| 3,426,937 | 2/1969 | Boschi et al. | 220/5 A X |
| 3,987,829 | 10/1976 | Leone | 220/72 X |

*Primary Examiner*—Steven M. Pollard
*Attorney, Agent, or Firm*—Roger A. Marrs

[57] ABSTRACT

A storage vault is disclosed herein having an integral container including opposite sides, opposite ends and an inter-connecting top and bottom. A central column is integrally joined at its opposite ends to the top and bottom respectively and an encircling rib integrally forms with the opposite sides and opposite ends midway between the top and bottom. Each rib portion associated with a side and an end is reinforced by a metal channel having a plurality of fasteners securing the channel thereto. Access openings and ports are provided the top and sides and integral depressions and indentations are provided in the container for structural strength.

1 Claim, 6 Drawing Figures

FIG. 1
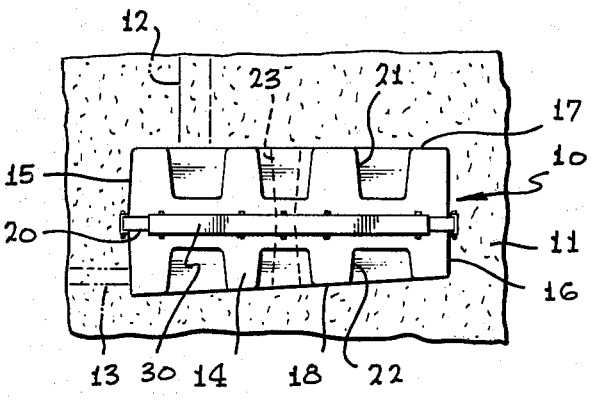
FIG. 4
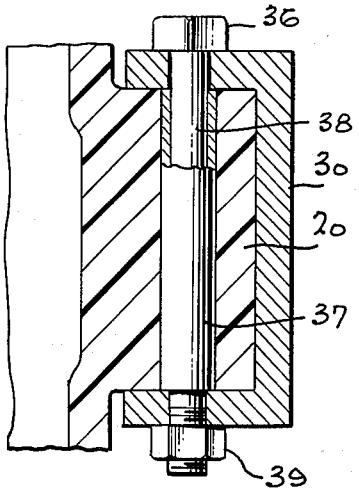
FIG. 5
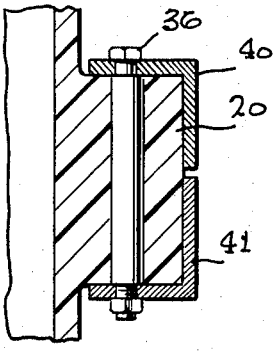
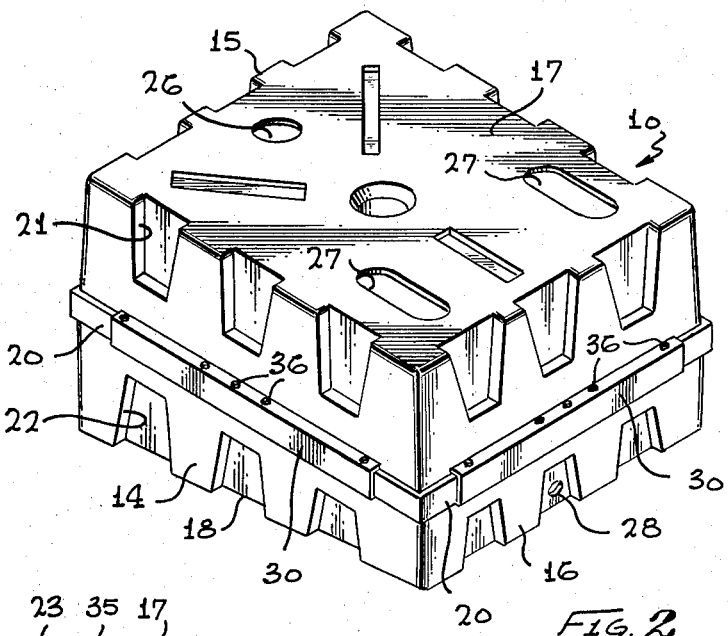
FIG. 2
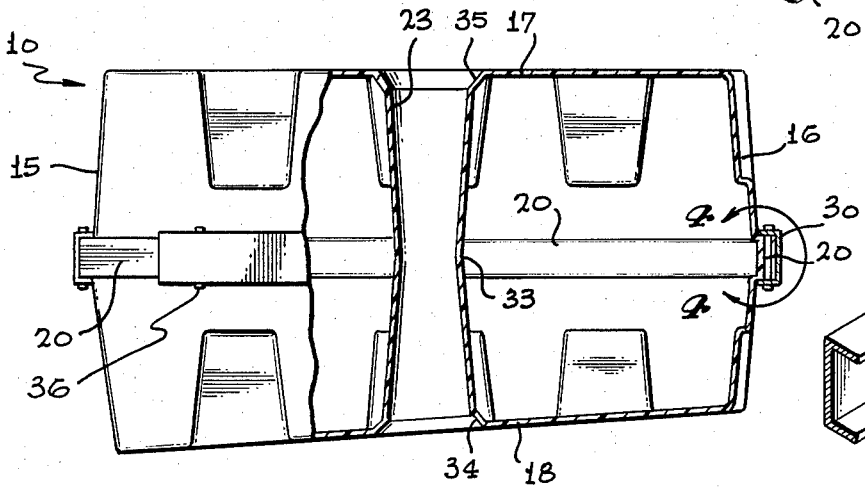
FIG. 3
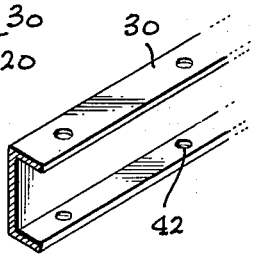
FIG. 6

UNDERGROUND STORAGE VAULT

BACKGROUND OF THE INVENTION

1. Field of the Invention

This invention relates to storage vaults and more particularly, to a novel storage container intended to be placed underground and which includes integral stiffening and reinforcement means for preventing the collapse of the container due to top and side loading by the surrounding earth.

2. Brief Description of the Prior Art

In the past, it has been the conventional practice to store a variety of solids and fluids in underground containers until such time as the containers can be emptied for reuse. Towards this end, the containers assume a configuration suitable for holding a large amount of the solids and fluids and further include means for access to the interior of the container or vault. Inasmuch as the container or vault is intended to be buried, a substantial loading of the top and sidewalls as well as the ends of the container or vault is encountered by the surrounding earth. For this reason, prior containers are generally of a cylindrical or spherical configuration which provides maximum rigidity and structural integrity of the vault.

Difficulties have been encountered with vaults of this configuration and structure mainly because the volume of the container is substantially reduced as compared to a square or oblong container or vault and means for reinforcing the sides of the vault structure are not compatible with the manufacturing procedures or techniques. Furthermore, prior underground vaults are generally reinforced fiberglass or concrete when it is needed, by external bracing and reinforced concrete structure. This type of construction greatly adds to the expense and complexity of the installation.

Therefore, a long standing need has existed to provide a novel underground vault which will provide maximum storage capacity and which provides maximum reinforcement by its integral construction and shape as opposed to external bracing and reinforcement means.

SUMMARY OF THE INVENTION

Accordingly, the above problems and difficulties are obviated by the present invention which provides a novel underground vault having a container of substantially square configuration which includes opposing sidewalls and opposite ends integrally formed together with a top and a bottom panel to assume a box-like structure. The container further includes a center column which is integrally formed at its opposite ends with the center of the top panel and bottom panel so that the central portion of the container is load-bearing and reinforced. An integral rib or thickened portion is included at the mid-section of the opposite sides and opposite ends which encircle the container for additional reinforcement and a metal channel is carried on the integral rib assiciated with each side and end. Fastening means are included for retaining the channel on the rib. Access openings and ports are included.

Therefore, it is among the primary objects of the present invention to provide a novel underground vault which is of substantial reinforced construction adapted to transfer and carry loads applied thereto by the surrounding earth.

Another object of the present invention is to provide a novel underground vault having increased storage capacity due to its square configuration and which includes a columnar support in the center thereof for accommodating applied loads from surrounding earth.

Still a further object of the present invention is to provide an underground storage vault of integral construction having columnar support and encircling rib support.

Still a further object of the present invention is to provide a unique underground storage vault which is relatively inexpensive to manufacture and which may be readily installed in the ground without the necessity of external bracing or concrete reinforcement.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a diagramatic illustration showing the novel storage vault of the present invention in a buried condition;

FIG. 2 is a perspective view of the novel underground storage vault shown in FIG. 1;

FIG. 3 is a side elevational view of the underground storage vault having a portion broken away to show the integral reinforcement construction;

FIG. 4 is an enlarged transverse cross-sectional view of the encircling rib and metal channel carried thereon as taken in the direction of arrows 4—4 of FIG. 3;

FIG. 5 is an alternate construction for the metal channel reinforcement; and FIG. 6 is a fragmentary perspective view of the reinforcing channel used in the embodiments shown in FIGS. 2–4 inclusive.

DESCRIPTION OF PREFERRED EMBODIMENT

Referring to FIG. 1, the novel underground storage vault of the present invention is indicated in general by the numeral 10 and is shown buried in earth 11 which completely surrounds and supports the container 10. Access to the interior of the vault for introducing solid or fluid material to the interior thereof may be via a pipe or other conduit indicated by the numeral 12 and a clean out or exit conduit or pipe 13 may also be provided. The storage vault 10 includes a container having opposite sides and ends which are joined by a top panel and a bottom panel so as to define a box-like structure. The view in FIG. 1 is of one side 14 and it is to be understood that the opposite side is identical thereto. The opposite ends are identified by numerals 15 and 16 while the top panel is identified by numeral 17 and the bottom panel by numeral 18. It can be seen that the top panel is parallel to a reinforcing rib 20 that encircles the container mid-way between the top panel and the bottom panel. However, it can be seen the bottom panel 18 is angularly disposed with respect to the reinforcement rib 20 so that the bottom of the container slopes in the direction of a clean-out or outlet conduit 13.

While the storage vault is illustrated in its varied installation, it is to be understood that the surrounding earth applies loads to the sided, ends, top and bottom panels which have a tendancy to collapse, distort or otherwise induce structural fatigue to the structure of the container. In order to adequately support the sides, ends and top and bottom panels of the container as well as to transfer the applied loads into different areas, the unique container includes the peripheral, encircling rib 20 as well as a plurality of integral depressions or indentations such as indicated by numeral 21 and 22 respectively provided in the side 14 of the container and partially into the adjacent top and bottom panels 17 and 18. Furthermore, substantial support to the top and bottom panels is provided by an integral columnar structure indicated in broken lines indicated by the numeral 23.

Referring now in detail to FIG. 2, the storage vault 10 is further illustrated as having a port 26 located in the top panel 17 for accommodating the inlet duct 12. Also, ports 27 and 28 may also be employed for introducing solid or liquid matter into the container. It is to be understood that the ports or openings can be located anywhere on the container and can be of any size in order to accommodate suitable solid or liquid material transferring pipes or conduits. A clean out port 28 may be provided in end panel 16 so that high pressure water may be introduced into the container for cleaning purposes.

It can be seen in FIG. 2 that the encircling rib 20 is carried on the opposite ends as well as the opposite sides of the container and that the rib resides mid-way between the top and bottom panels. Each rib associated with an end or side carries a reinforcing metal channel such as channel 30 carried on the rib 20 associated with side 14. Numeral 30 prime pertains to the channel associated with the rib 20 prime carried on end 16.

FIG. 2 also shows that one end of the support column 23 is integrally formed with the top panel 17 as indicated by the numeral 31. The joining of the column with the panel is integral and is open so that a central air shaft extends through the column.

Referring now in detail to FIG. 3, it can be seen that the column 23 is of a double frustro-conical configuration wherein a pair of conical portions are joined at a parting line indicated by numeral 33 wherein one portion terminates at its opposite end in a flared joint 34 with the bottom panel 18 while the other portion terminates in a flared joint 35 with the top panel 17. The columnar form is of high strength and adequately supports the loads presented to the container by the surrounding earth so that the top and the bottom panels will not collapse under the load. Also, the columnar structure does not occupy very much storage space so that maximum area is available for storage purposes within the interior of the container or vault. FIG. 3 also illustrates that the channels 30 are held to the ribs 20 by a plurality of fastening means 36.

In FIG. 4, it can be seen that the rib 20 carries a respective channel 30 thereon by means of the fastener 36. Preferably, the rib 20 is provided with a hole and a sleeve 37 is molded in place which is adapted to insertably receive a bolt 38 having a nut 39 for securment. An alternate version is shown in FIG. 5 wherein the channel 30 is divided into a pair of L-shaped channels 40 and 41. However, the fastener means 36 is employed to secure the channel portions to the rib 20. The plurality of channels provided on the opposite sides and ends of the container are intended to handle and transfer lateral loads produced by the surrounding earth. In particular, it is the general practice to pack sand around the container and this provides an external load such that without support by the column 23 and the rib and channels 30, the sides and ends would buckle. FIG. 6 shows a typical channel 30 having a plurality of holes in each of its legs in registry with each other so that the holes 42 will receive the sleeve and fastener means 36.

In actual practice, a hole is dug and the vault or container 10 is placed therein. A substantial amount of sand is packed around the container and placed on the top of the container so that it is completely buried. Inlets may be provided which permit solid or liquid matter to be placed into the container for storage. In one example, the storage vault of the present invention may be used in connection with outdoor toilets and latrines. The vertical column 23 supports the weight on top of the container and all vertical loads thereto while the channels and ribs support the lateral loads. The sides, ends and top and bottom panels are integrally formed as well as the column structure so that maximum strength is provided.

While particular embodiments of the present invention have been shown and described, it will be obvious to those skilled in the art that changes and modifications may be made without departing from the invention in its broader aspects and, therefore, the aim in the appended claims is to cover all such changes and modifications as fall within the true spirit and scope of this invention.

What is claimed is:

1. An under ground storage vault comprising:

a box-like storage container having opposite sides, opposite ends and top and bottom panels carried thereon so as to define a storage compartment between the opposing interior surfaces thereof:

a central column extending along a vertical axis through said storage compartment substantially at center thereof having its opposite ends integrally joined with said top and bottom panels respectively;

a continuous rib carried on the exterior surfaces of said sides and ends midway between said top and bottom panels for conducting lateral loads applied by surrounding earth;

said continuous rib includes an elongated metal channel secured to a central length or portion of said rib associated with each of said sides and ends;

said vertical column is a pair of frustroconical section integrally joined at their adjacent ends and terminating at their opposite ends in a flared junction with said respective top and bottom panels;

removable fastener means joining each of said side and said end channels to its respective rib portion;

said fastener means includes a plurality of metal sleeves molded in place on said rib portion and a plurality of holes carried in said channel in registry with said sleeves;

bolts insertably received through said holes and sleeves for retaining said channel onto said rib portion;

said bottom panel slopes at an angle from one end of said box-like container to its opposite end;

said top and said bottom panels include integrally formed stiffeners;

said edge marginal regions of said top and bottom panels as well as said opposite sides and ends are provided with integral indentations providing increased rigidity;

said fastener means constitute shear pins arranged to support and carry lateral loads applied to said rib;

said container includes access ports and openings for the passage of solid and liquid waste products.

* * * * *